US006571492B2

(12) United States Patent
Greenwood

(10) Patent No.: US 6,571,492 B2
(45) Date of Patent: Jun. 3, 2003

(54) CONTINUOUS DITCH EXCAVATOR

(76) Inventor: Todd H. Greenwood, 1959 N. Peace Haven Rd. #179, Winston-Salem, NC (US) 27106-4850

( * ) Notice: Subject to any disclaimer, the term of this patent is extended or adjusted under 35 U.S.C. 154(b) by 0 days.

(21) Appl. No.: 10/047,839

(22) Filed: Oct. 22, 2001

(65) Prior Publication Data

US 2002/0062585 A1 May 30, 2002

Related U.S. Application Data

(63) Continuation of application No. 09/559,765, filed on Apr. 27, 2000, now Pat. No. 6,305,879.

(51) Int. Cl.[7] ..... E02F 5/04

(52) U.S. Cl. ..... 37/348; 37/350; 37/417; 405/154.1

(58) Field of Search ..... 37/347, 348, 350, 37/412, 417, 432, 189, 462, 464; 405/174, 179, 154.1; 171/116, 144; 701/50

(56) References Cited

U.S. PATENT DOCUMENTS

| | | | | | |
|---|---|---|---|---|---|
| 82,846 | A | | 10/1868 | Jones | |
| 328,407 | A | * | 10/1885 | Humphreys | 37/350 |
| 363,560 | A | * | 5/1887 | Stewart | 37/350 |
| 574,660 | A | | 1/1897 | Carroll | |
| 606,987 | A | * | 7/1898 | Clark | 37/190 |
| 1,071,477 | A | | 8/1913 | Stowe | |
| 1,405,256 | A | * | 1/1922 | Bates | 37/386 |
| 2,048,710 | A | * | 7/1936 | Ranney | 37/351 |
| 2,545,016 | A | | 3/1951 | Berry | |
| 3,075,658 | A | | 1/1963 | Neighbour | |
| 3,130,506 | A | | 4/1964 | Laster | |
| 3,257,662 | A | * | 6/1966 | Smith | 37/350 |
| 3,290,804 | A | * | 12/1966 | Hanson | 37/142.5 |
| 3,406,767 | A | | 10/1968 | Watts | |
| 3,443,326 | A | | 5/1969 | Saumenig | |
| 3,646,767 | A | | 3/1972 | Shelley | |
| 3,813,171 | A | * | 5/1974 | Teach et al. | 172/4.5 |
| 3,893,302 | A | | 7/1975 | Peterson | |
| 3,896,570 | A | | 7/1975 | McMurray | |
| 3,903,624 | A | | 9/1975 | Holl | |
| 3,934,363 | A | | 1/1976 | McMurray | |
| 4,098,012 | A | | 7/1978 | Parrish | |
| 4,395,158 | A | | 7/1983 | Brooks | |
| 4,751,971 | A | * | 6/1988 | Thompson | 111/116 |
| 4,872,275 | A | | 10/1989 | Beckett et al. | |
| 5,462,122 | A | | 10/1995 | Yamamoto et al. | |
| 5,764,511 | A | | 6/1998 | Henderson | |
| 6,220,786 | B1 | | 4/2001 | Ollason et al. | |

* cited by examiner

*Primary Examiner*—Thomas B. Will
*Assistant Examiner*—Thomas A. Beach
(74) *Attorney, Agent, or Firm*—Adams, Schwartz & Evans, P.A.

(57) ABSTRACT

A continuous ditch excavator including a chassis having a forward portion and a rear portion, first and second motive elements carried by the chassis in laterally spaced-apart relation to each other for cooperatively driving the chassis along a ground surface, the first and second motive elements defining a centrally-disposed excavation work area therebetween, and an excavating auger mounted on the chassis in the excavation work area forwardly of the rear portion of the chassis and rearwardly of the forward portion of the chassis for penetrating and excavating a ditch in the ground as the chassis is driven along the ground,the auger defining a pivot point about which the first and second motive means are adapted to rotate the chassis to control the direction of ditch excavation. The excavator also includes a motor for driving the first and second motive elements and rotating the auger, and controls for controlling the excavator, whereby rotating the chassis about the pivot point defined by the auger permits changes in the direction of ditch excavation in correlation with the change in direction of the chassis.

23 Claims, 10 Drawing Sheets

CONTINUOUS DITCH EXCAVATOR

This application is a Rule 37 C.F.R. §1.53(b) Continuation Application of U.S. Ser. No. 09/559,765 filed on Apr. 27, 2000 now U.S. Pat. No. 6,305,879 issued Oct. 23, 2001. This invention relates to a continuous ditch excavator.

TECHNICAL FIELD AND BACKGROUND OF INVENTION

Many types of development projects, including residential and commercial construction and irrigation, as well as underground utility installation involving the burying of pipe or conduit, involve ditch excavation. Such ditches must frequently be angled and/or curved in order to stay within the confines of the property owned by the person authorizing the excavation or to avoid encountering natural and artificial barriers such as waterways, desired wooded areas, and preexisting underground utility installations.

Prior art ditch excavators typically include augers or other digging implements that are mounted on or near the front of the excavator. This arrangement precludes continuous excavation at corners and curves in the ditch, because such excavators must cease excavation and reorient themselves whenever corners and curves in the ditch are desired. This interruption becomes more and more pronounced as the angle of the turn becomes greater; turns of 90 to 180 degrees are especially troublesome. This problem results not only in temporary work stoppage, but also in potentially inconsistent ditches. The width and depth of the ditch, as well as the pitch of the ditch walls, may vary with each retraction, reorientation, and re-engagement of the excavator at turns in the desired ditch path. In addition, with the necessary reorientation of the excavator comes the risk of misguiding the excavator during reorientation such that the integrity of the portion of the ditch that has already been excavated is compromised or damaged.

The present invention solves this problem by providing a continuous ditch excavator with a substantially centrally-disposed auger that enables the excavator chassis to rotate about the auger, thereby allowing the excavator to make turns at any angle without the need for retracting the auger from the ditch. Such a design ensures ditch consistency and integrity as well as avoidance of work stoppages caused by excavator retraction and reorientation.

SUMMARY OF THE INVENTION

Therefore, it is an object of the invention to provide a continuous ditch excavator.

It is another object of the invention to provide a continuous ditch excavator that may excavate ditches having corners and curves without having to retract the auger or other digging implement from the ditch.

It is another object of the invention to provide a continuous ditch excavator that minimizes work stoppages associated with retraction, reorientation, and re-engagement of the excavator at corners and curves in the desired ditch path.

It is another object of the invention to provide a continuous ditch excavator that preserves the integrity of ditch walls at curves and corners in the ditch.

It is another object of the invention to provide a continuous ditch excavator that helps ensure consistency of ditch width and depth.

It is another object of the invention to provide a continuous ditch excavator that generally eases and expedites excavation of ditches having corners and curves, especially when the ditch path includes turns of 90 to 180 degrees.

It is another object of the invention to provide a continuous ditch excavator that may be controlled by a human operator from a position either aboard or separate from the excavator or by automation.

It is another object of the invention to provide a continuous ditch excavator that prevents soil removed from the ground by the auger from falling into the ditch as the auger is raised out of the ditch.

It is another object of the invention to provide a continuous ditch excavator that provides a bin for containing soil removed from the ground and means for emptying the soil containment bin when desired.

These and other objects of the present invention are achieved in the preferred embodiments disclosed below by providing a continuous ditch excavator including a chassis having a forward portion and a rear portion, first and second motive means carried by the chassis in laterally spaced-apart relation to each other for cooperatively driving the chassis along a ground surface, the first and second motive means defining a centrally-disposed excavation work area therebetween, an excavating auger mounted on the chassis in the excavation work area forwardly of the rear portion of the chassis and rearwardly of the forward portion of the chassis for penetrating and excavating a ditch in the ground as the chassis is driven along the ground, the auger defining a pivot point about which the first and second motive means are adapted to rotate the chassis to control the direction of ditch excavation, motor means for driving the first and second motive means and rotating the auger, and control means for controlling the excavator, whereby rotating the chassis about the pivot point defined by the auger permits changes in the direction of ditch excavation in correlation with the change in direction of the chassis.

According to one preferred embodiment of the invention, the auger is mounted in a substantially vertical position.

According to another preferred embodiment of the invention, the motor means is adapted for raising and lowering the auger.

According to yet another preferred embodiment of the invention, the motor means includes an engine mounted on the chassis for driving the first and second motive means and a hydraulic motor mounted on the chassis for rotating, raising, and lowering the auger.

According to yet another preferred embodiment of the invention, lift means are mounted on the chassis for raising and lowering the auger.

According to yet another preferred embodiment of the invention, the first and second motive means comprise caterpillar tracks.

According to yet another preferred embodiment of the invention, a containment bin is mounted on the chassis in proximity to the auger for receiving soil removed from the ground by the auger.

According to yet another preferred embodiment of the invention, emptying means are provided adjacent to the containment bin for emptying the contents of the containment bin.

According to yet another preferred embodiment of the invention, a containment shield resides adjacent to the auger for preventing the soil removed by the auger from falling back into the ditch as the auger is raised out of the ditch.

According to yet another preferred embodiment of the invention, the containment shield includes a first shield component proximal to the forward portion of the chassis and a second shield component proximal to the rear portion of the chassis for partially surrounding the auger as it is raised and lowered into and out of the ditch.

According to yet another preferred embodiment of the invention, the first and second shield components are complementary, spaced-apart, arcuate plates partially surrounding the auger.

According to yet another preferred embodiment of the invention, the control means includes an operator cab containing the control means and mounted on the chassis for accommodating an operator.

According to yet another preferred embodiment of the invention, the control means includes a plurality of direction and speed controls in the operator cab for manipulating the excavator.

According to yet another preferred embodiment of the invention, the control means includes a sensor on the excavator for receiving control signals from a remote control unit comprising speed and direction controls, and a processor on the excavator for interpreting the control signals received from the remote control unit by the sensor and for directing the excavator to execute operations included in the control signals.

According to yet another preferred embodiment of the invention, the control means includes a distance and direction sensor mounted on the chassis for sending and receiving information concerning movement of the first and second motive means, a distance and direction processor mounted on the chassis for interpreting the information received by the distance and direction sensor and executing directions contained therein, and an elevation monitor mounted on the chassis for sending and receiving laser signals to and from a laser level positioned in spaced-apart relation to the excavator at a predetermined location, wherein the distance and direction sensor, the elevation monitor, and the laser level of the control means are controlled by a preprogrammed sequence of computerized instructions for directing the excavator along a predetermined path.

According to one preferred embodiment of the invention, a continuous ditch excavator is provided with a chassis having a forward portion and a rear portion, a plurality of caterpillar tracks carried by the chassis in laterally spaced-apart relation to each other for cooperatively driving the chassis along ground, said caterpillar tracks defining a centrally-disposed excavation work area therebetween, an excavating auger mounted in a substantially vertical position on the chassis in the excavation work area, forwardly of the rear portion of the chassis and rearwardly of the forward portion of the chassis, for penetrating and excavating a ditch in the ground as the chassis is driven along the ground, said auger defining a pivot point about which the caterpillar tracks are adapted to rotate the chassis to control the direction of ditch excavation, whereby rotating the chassis about the pivot point defined by the auger permits changes in the direction of ditch excavation in correlation with the change in direction of the chassis, and an engine mounted on the chassis for driving the caterpillar tracks. The excavator also includes a hydraulic motor mounted on the chassis for rotating, raising, and lowering the auger, lift means mounted on the chassis for raising and lowering the auger, a containment bin mounted on the chassis in proximity to the auger for receiving soil removed from the ground by the auger, emptying means provided adjacent the containment bin for emptying the contents of the containment bin, a plurality of complementary, spaced-apart, arcuate plates mounted adjacent to and partially surrounding the auger for preventing the soil removed by the auger from falling back into the ditch as the auger is raised out of the ditch, and control means for controlling the excavator, including an operator cab and a plurality of direction and speed controls accessible from the operating cab for manipulating the excavator.

According to one preferred embodiment of the invention, a continuous ditch excavator is provided with a chassis having a forward portion and a rear portion, a plurality of caterpillar tracks carried by the chassis in laterally spaced-apart relation to each other for cooperatively driving the chassis along ground, said caterpillar tracks defining a centrally-disposed excavation work area therebetween, an excavating auger mounted in a substantially vertical position on the chassis in the excavation work area, forwardly of the rear portion of the chassis and rearwardly of the forward portion of the chassis, for penetrating and excavating a ditch in the ground as the chassis is driven along the ground, said auger defining a pivot point about which the caterpillar tracks are adapted to rotate the chassis to control the direction of ditch excavation, whereby rotating the chassis about the pivot point defined by the auger permits changes in the direction of ditch excavation in correlation with the change in direction of the chassis, an engine mounted on the chassis for driving the caterpillar tracks, and a hydraulic motor mounted on the chassis for rotating, raising, and lowering the auger. The excavator also includes lift means mounted on the chassis for raising and lowering the auger, a containment bin mounted on the chassis in proximity to the auger for receiving soil removed from the ground by the auger, emptying means provided adjacent the containment bin for emptying the contents of the containment bin, a plurality of complementary, spaced-apart, arcuate plates mounted adjacent to and partially surrounding the auger for preventing the soil removed by the auger from falling back into the ditch as the auger is raised out of the ditch, and control means for controlling the excavator, including a sensor on the excavator for receiving control signals from a remote control unit comprising speed and direction controls, and a processor on the excavator for interpreting the control signals received from the remote control unit by the sensor and for directing the excavator to execute operations included in the control signals.

According to one preferred embodiment of the invention, a continuous ditch excavator is provided with a chassis having a forward portion and a rear portion, a plurality of caterpillar tracks carried by the chassis in laterally spaced-apart relation to each other for cooperatively driving the chassis along ground, said caterpillar tracks defining a centrally-disposed excavation work area therebetween, an excavating auger mounted in a substantially vertical position on the chassis in the excavation work area, forwardly of the rear portion of the chassis and rearwardly of the forward portion of the chassis, for penetrating and excavating a ditch in the ground as the chassis is driven along the ground, said auger defining a pivot point about which the caterpillar tracks are adapted to rotate the chassis to control the direction of ditch excavation, whereby rotating the chassis about the pivot point defined by the auger permits changes in the direction of ditch excavation in correlation with the change in direction of the chassis, and an engine mounted on the chassis for driving the caterpillar tracks. The excavator also includes a hydraulic motor mounted on the chassis for rotating, raising, and lowering the auger, lift means mounted on the chassis for raising and lowering the auger, a containment bin mounted on the chassis in proximity to the auger for receiving soil removed from the ground by the auger, emptying means provided adjacent the containment bin for emptying the contents of the containment bin, a plurality of complementary, spaced-apart, arcuate plates mounted adjacent to and partially surrounding the auger for preventing the soil removed by the auger from falling back into the ditch as the auger is raised out of the ditch, and control means for controlling the excavator, including a distance and direction sensor mounted on the chassis for sending and receiving information concerning movement of the first and second motive means, a distance and direction processor mounted on the chassis for interpreting the information received by the distance and direction sensor and executing directions contained therein, and an elevation monitor mounted on the chassis for sending and receiving laser signals to and from a laser level positioned in spaced-apart relation to the excavator at a predetermined location, wherein the distance and direction sensor and processor, the elevation monitor, and the laser level of the control means are controlled by a pre-programmed sequence of computerized instructions for directing the excavator along a predetermined path.

According to one claimed method, a method for continuous excavation of ditches is provided including the steps of providing a movable chassis with an excavating auger centrally mounted between a forward portion and a rear portion of the chassis, the auger defining a pivot point about which the chassis may be rotated, penetrating the auger into the ground, moving the chassis along a predetermined path as the auger is rotated for lifting soil from the earth to form a ditch along the predetermined path, and rotating the chassis about the pivot point defined by the auger for changing the direction of the ditch according to the predetermined path.

According to another claimed method, the method further comprises the step of lifting the soil into a containment bin for disposal adjacent the ditch.

According to yet another claimed method, the method further comprises the step of emptying the contents of the containment bin.

According to yet another claimed method, the method further comprises the step of preventing the soil removed by the auger from falling away from the auger into the ditch.

According to yet another claimed method, the method further comprises the step of controlling the excavator with a human operator aboard the excavator.

According to yet another claimed method, the method further comprises the step of controlling the excavator with a human operator located a point separated from the excavator.

According to yet another claimed method, the method further comprises the step of controlling the excavator according to a preprogrammed sequence of computerized instructions.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
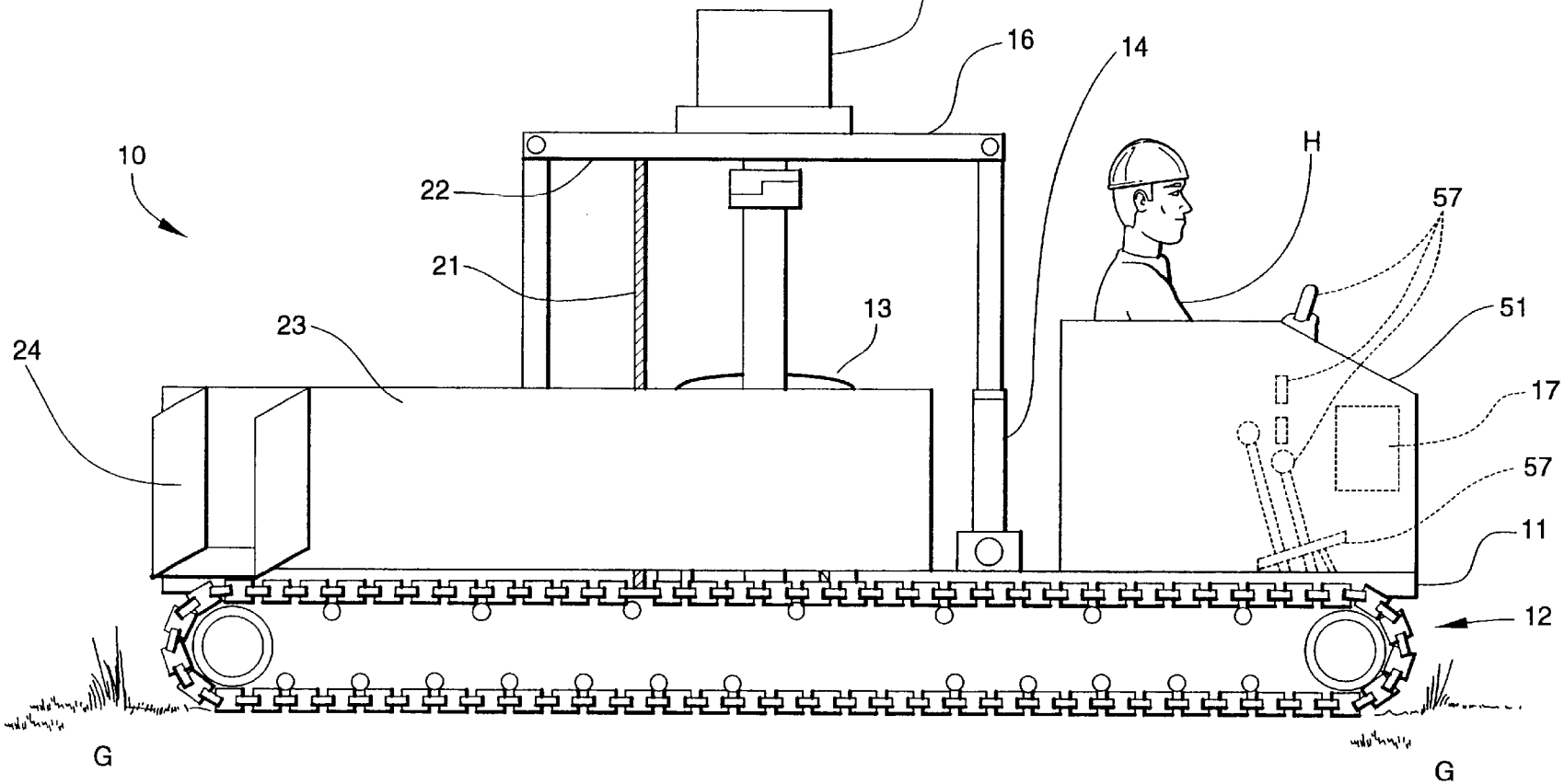
FIG. 1 is a side elevation of a continuous ditch excavator according to a preferred embodiment of the invention, with operator shown.
Figure 8:
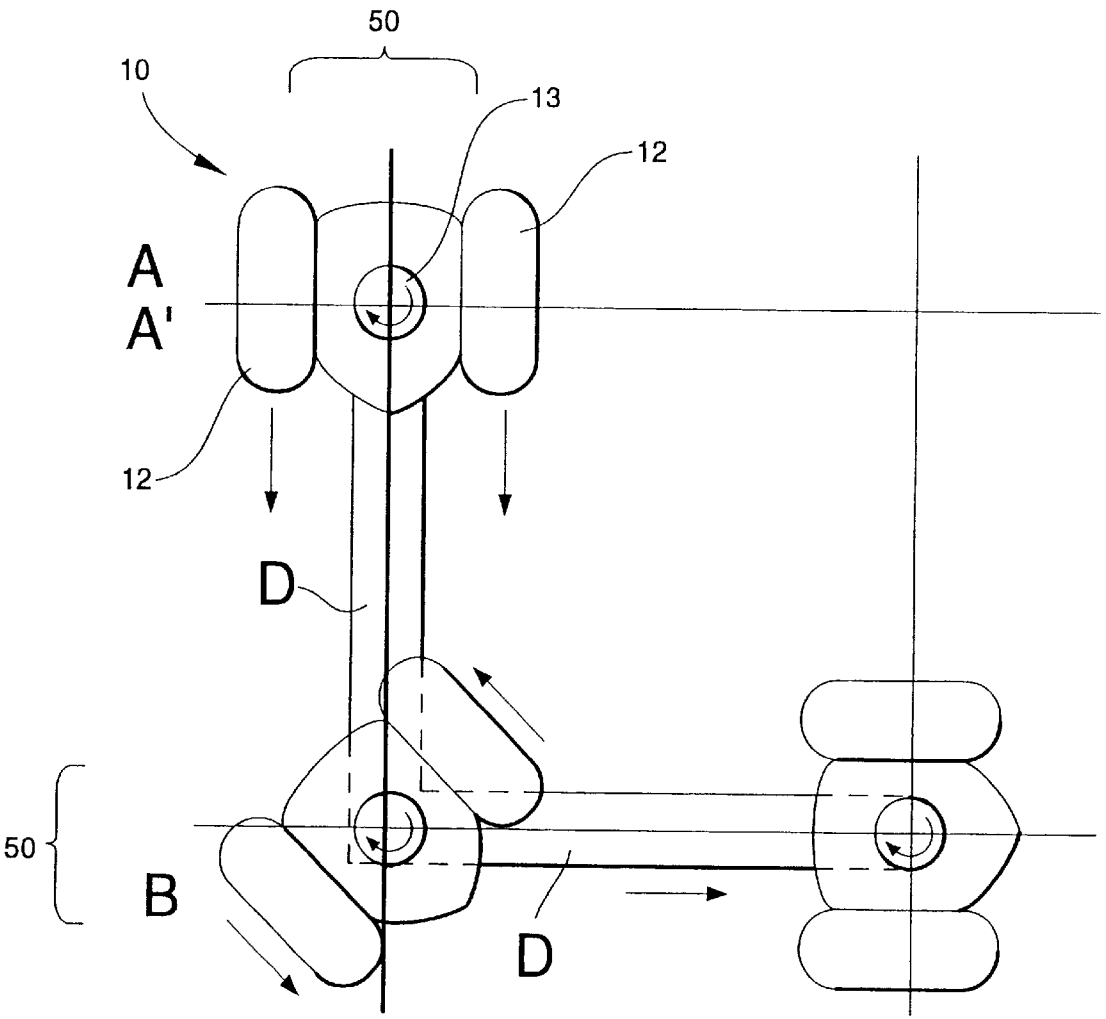
FIG. 8 is a top plan view of a simplified line drawing of a continuous ditch excavator according to a preferred embodiment of the invention showing the excavator at three successive stages of excavation, including the continuous excavation of a 90-degree turn in the ditch path.

Referring now specifically to the drawings, a continuous ditch excavator according to the present invention is illustrated in FIG. 1 and shown generally at reference numeral 10 with a human operator aboard. Most basically, the excavator comprises a chassis 11 and motive means such as caterpillar tracks 12 for moving the chassis 11 along the ground "G". The caterpillar tracks 12 are driven by motor means such as a gasoline engine 17. The motor means driving the caterpillar tracks 12 could instead comprise a diesel engine, an electric motor, or a hydraulic motor. The motive means could instead comprise wheels or moving belts. In a preferred embodiment, a pair of caterpillar tracks (one track shown at 12) are spaced apart to define a central excavation area (FIG. 8, reference numeral 50). To achieve excavation, an auger 13 carried by an auger support 16 is raised, lowered, and rotated within the excavation area (FIG. 8, ref. num. 50) to engage, penetrate, and remove soil from the ground "G" as needed to form a ditch (not shown) of predetermined dimensions. The ditch in the excavation area (FIG. 8, ref. num. 50) is straddled by the caterpillar tracks 12.

Figure 2:
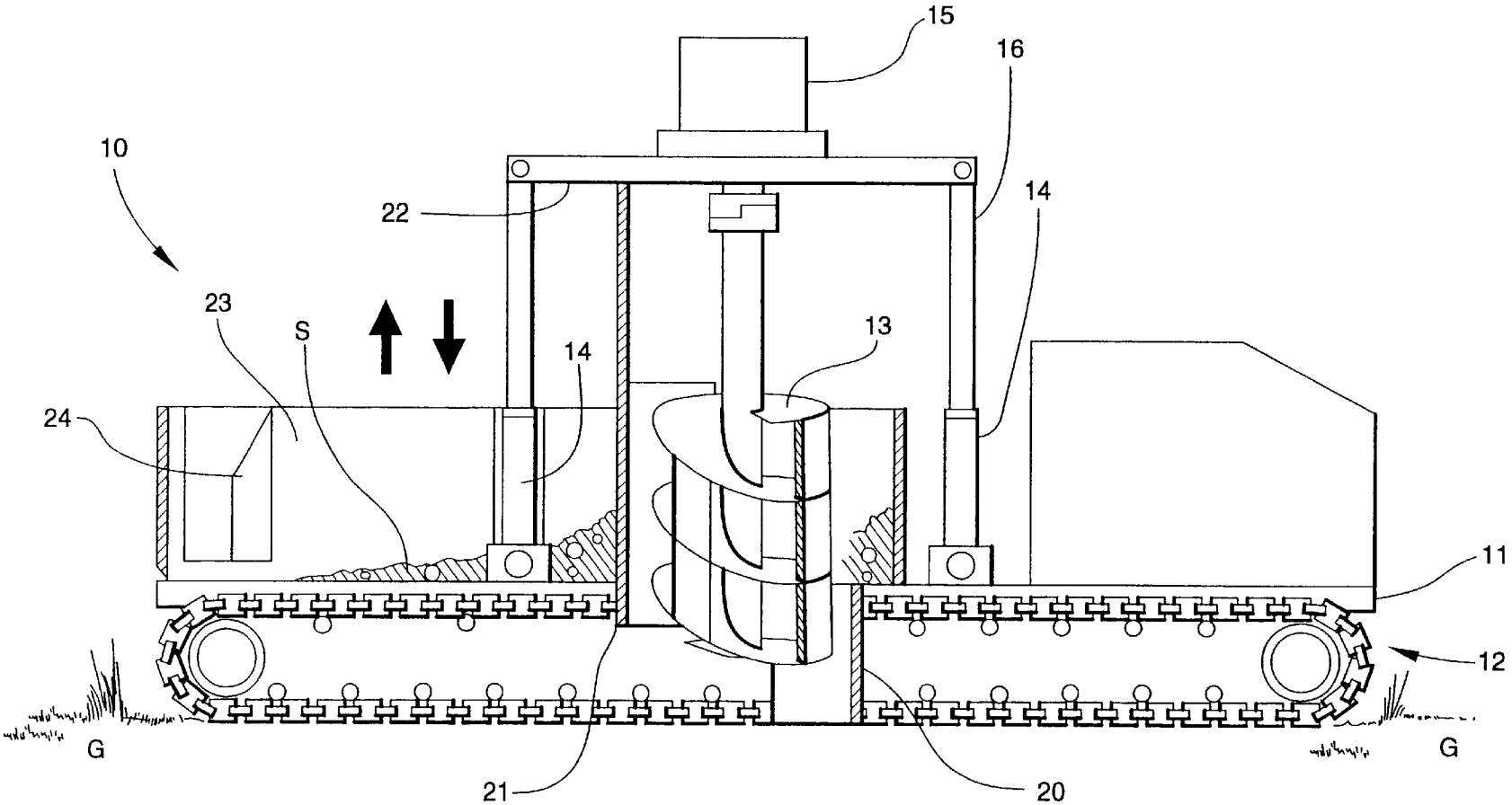
FIG. 2 is a partial cross-section taken generally along the length of a continuous ditch excavator according to a preferred embodiment of the invention in order to illustrate the structure of the internal machinery of the excavator with the auger in a raised position and showing arrows indicating the ability of the lifts to raise and lower the auger.
Figure 3:
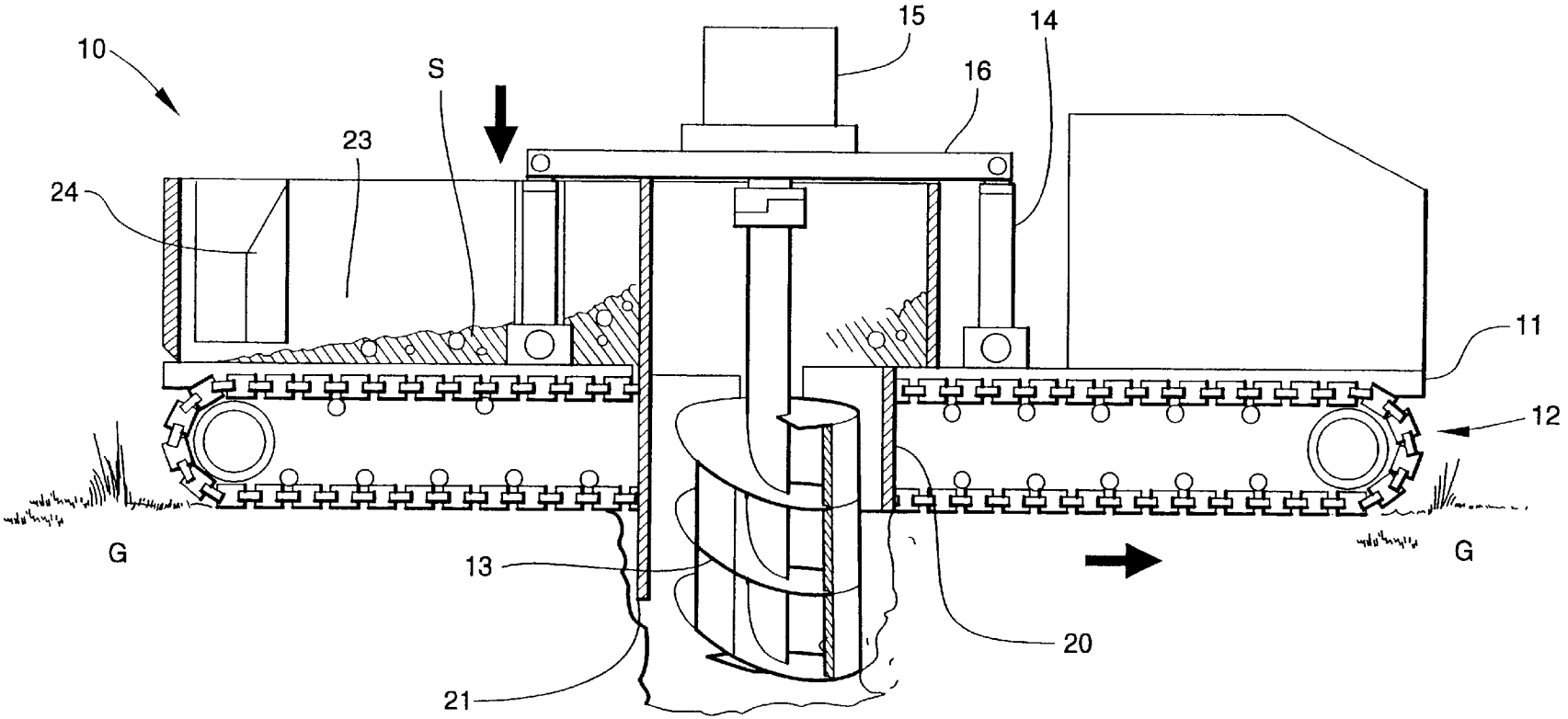
FIG. 3 is a partial cross-section taken generally along the length of a continuous ditch excavator according to a preferred embodiment of the invention after the auger of the excavator has been lowered and rotated to penetrate the ground to a desired ditch depth, the arrow in the top left portion of the drawing indicating the lowered position of the lifts and the arrow in the bottom right portion of the drawing indicating the travel direction of the excavator.
Figure 4:
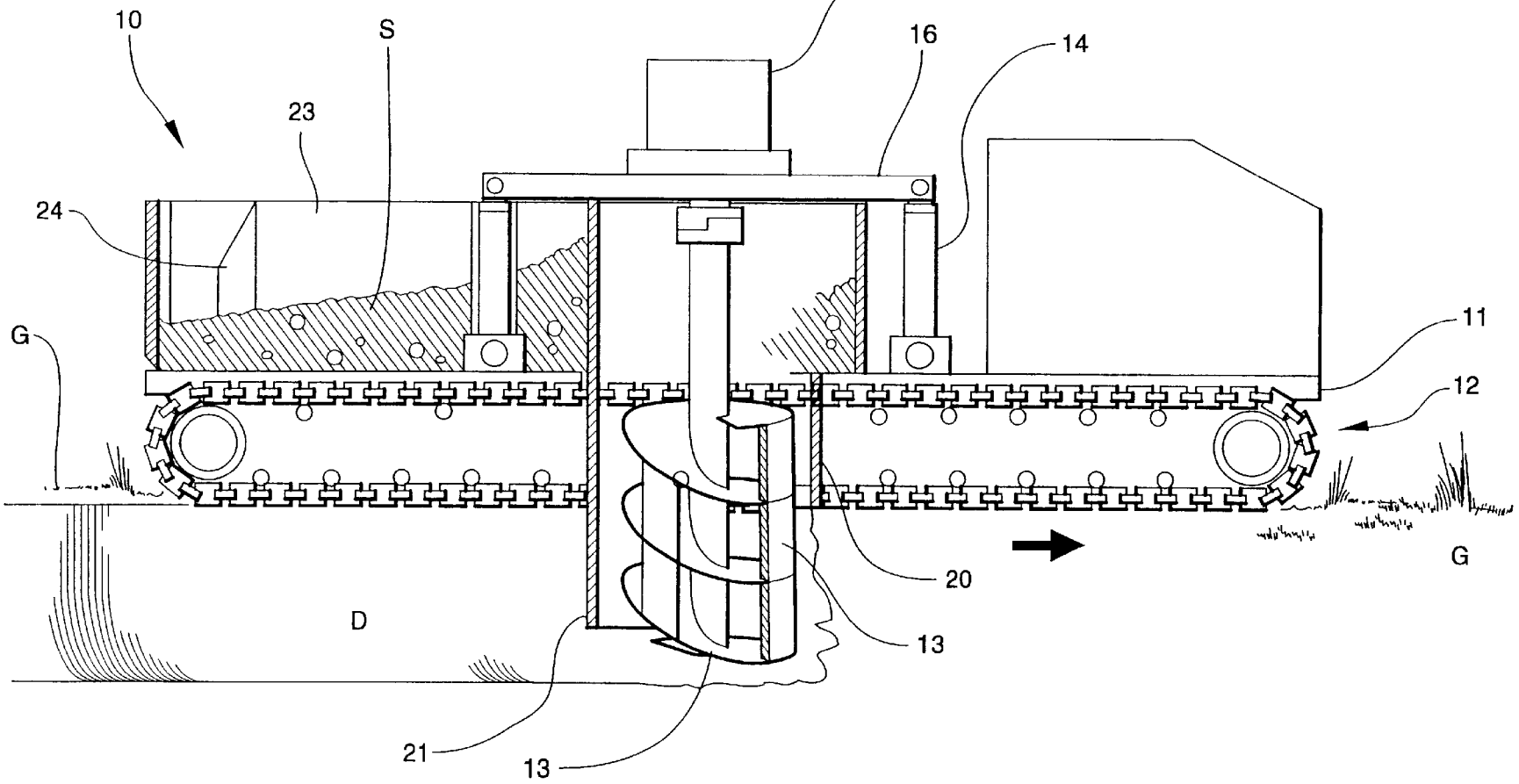
FIG. 4 is a partial cross-section taken generally along the length of a continuous ditch excavator according to a preferred embodiment of the invention after a portion of the desired ditch has been excavated, the arrow in the bottom right portion of the drawing indicating the travel direction of the excavator.

FIGS. 2, 3, and 4 show cross-sectional views of the excavator 10 in three successive stages of operation. FIG. 2 shows the excavator 10 before the auger 13 is lowered to engage the ground "G". As indicated by the arrows in FIG. 2, the auger 13 is raised and lowered as necessary by lift means such as a plurality of hydraulic lifts 14 engaging the auger support 16 and mounted on the chassis 11. Alternatively, the lift means may be gears or pulleys or other non-hydraulic lifting means. The auger 13 is rotated and the lift means 14 are actuated by motor means such as a hydraulic motor 15 mounted on the auger support 16. The motor means driving the auger 13 and lift means 14 could instead comprise a gasoline engine, a diesel engine, or an electric motor.

The excavator 10 includes elements for controlling and containing the soil removed from the ground "G". First, in order to prevent the removed soil from falling back into the ditch as the auger 13 is raised out of the ditch, the excavator 10 includes a containment shield 20, 21 comprising a front containment shield component 20 and a rear containment shield component 21. In a preferred embodiment, the front and rear containment shield components 20, 21 are complementary, spaced-apart, and arcuate plates mounted on the chassis 11 for partially surrounding the auger 13. As the soil-filled auger 13 is lifted out of the ditch by the lifts 14, the containment shield 20, 21 prevents the soil on the auger 13 from falling back into the ditch.

The rear containment shield component 21 extends from an undersurface 22 of the auger support 16 substantially the length of the auger 13 to follow the travel of the auger 13 into and out of the ditch. However, the rear containment shield component is sufficiently short to allow the auger 13 to engage the ground "G" and begin excavation without hindrance. The front containment shield component 20 extends from the chassis 11 to approximately just above the level of the ground "G". In a preferred embodiment, the front containment shield component 20 does not extend above the chassis 11. This configuration of the containment shield 20, 21 provides for maximum control of the soil residing on the rising auger 13.

As the auger 13 is raised out of the ditch past the front containment shield component 20, the soil on the auger falls into a containment bin 23 mounted on the chassis 11. As the containment bin 23 begins to fill up with soil "S", the soil "S" flows out of the containment bin through emptying means such as exit troughs 24. Alternatively, the emptying means may comprise conveyors for removing the soil "S" from the containment bin 23 or hydraulic lifts for dumping out the containment bin 23. The exit troughs 24 of the preferred embodiment empty the soil "S" in the containment bin onto the ground "G" on either side of the ditch. The exit troughs 24 may be provided with doors (not shown) to control the soil flow therethrough.

FIG. 3 shows the excavator 10 after the auger 13 has penetrated the ground "G", with a large arrow showing the direction of forward travel of the excavator 10. FIG. 4 then shows the excavator 10 after the auger 13 has penetrated the ground "G" and partially excavated a ditch "D," again with a large arrow showing the direction of forward travel.

Figure 5A:
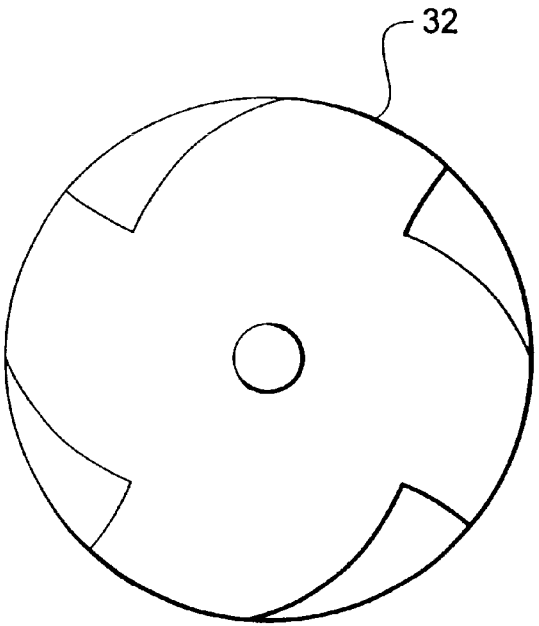
FIG. 5A is a horizontal cross-section taken generally through line 5A—5A of FIG. 5 and showing the blade configuration of the helical auger bit with vertically spaced blades.
Figure 5:
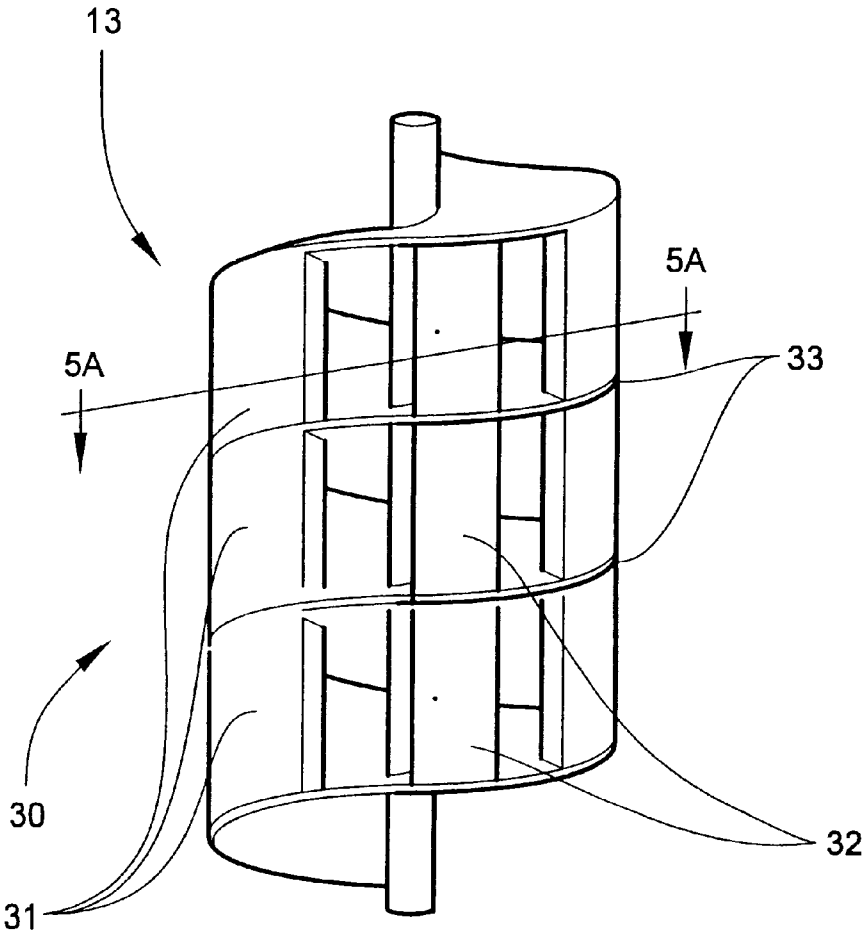
FIG. 5 is a perspective view of a helical auger bit with vertically spaced blades for use on a continuous ditch excavator according to a preferred embodiment of the invention.
Figure 6A:
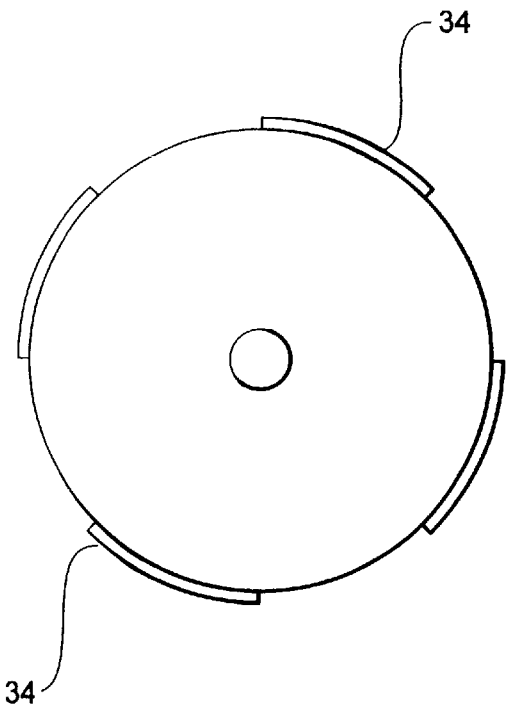
FIG. 6A is a horizontal cross-section taken generally through line 6A—6A of FIG. 6 and showing the blade configuration of the helical auger bit with vertically unitary blades.
Figure 6:
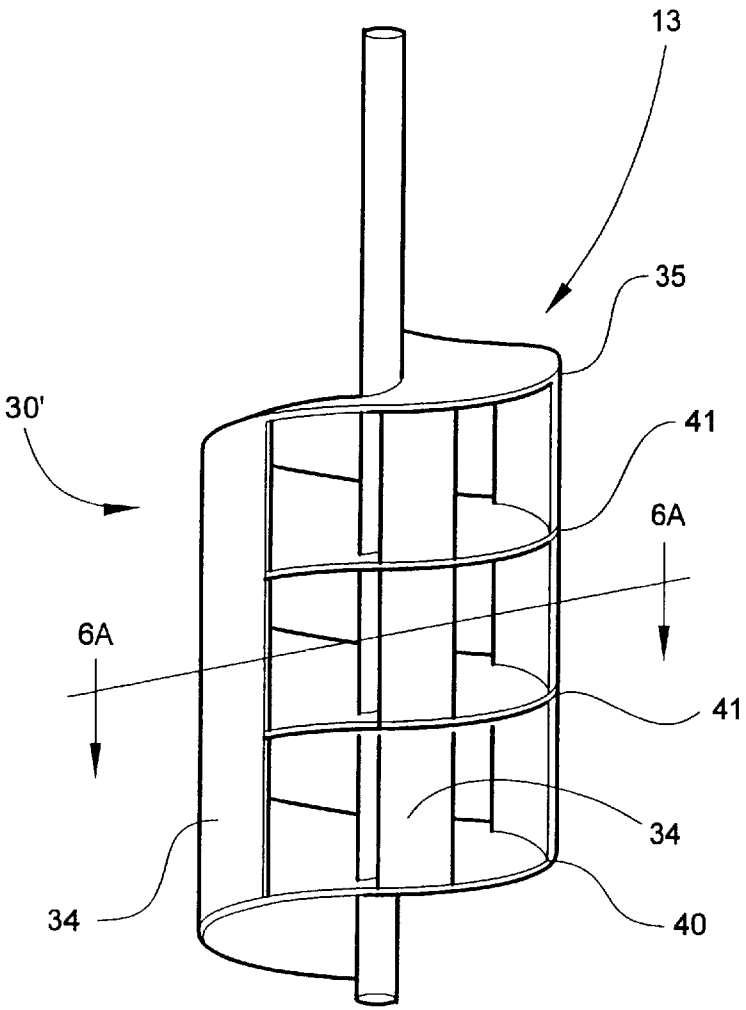
FIG. 6 is a perspective view of a helical auger bit with vertically unitary blades for use on a continuous ditch excavator according to a preferred embodiment of the invention.
Figure 7A:
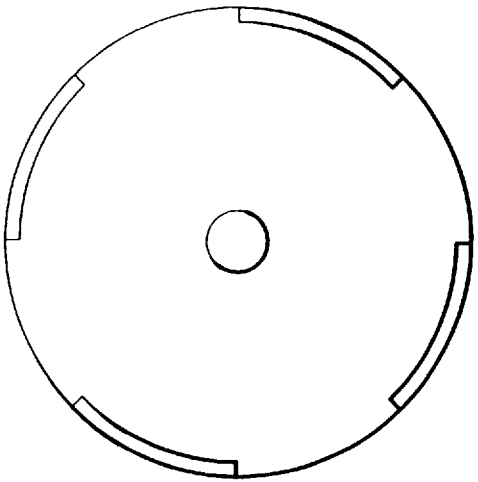
FIG. 7A is a horizontal cross-section taken generally through line 7A—7A of FIG. 7 and showing the blade configuration of the helical auger bit with tapered blades.
Figure 7:
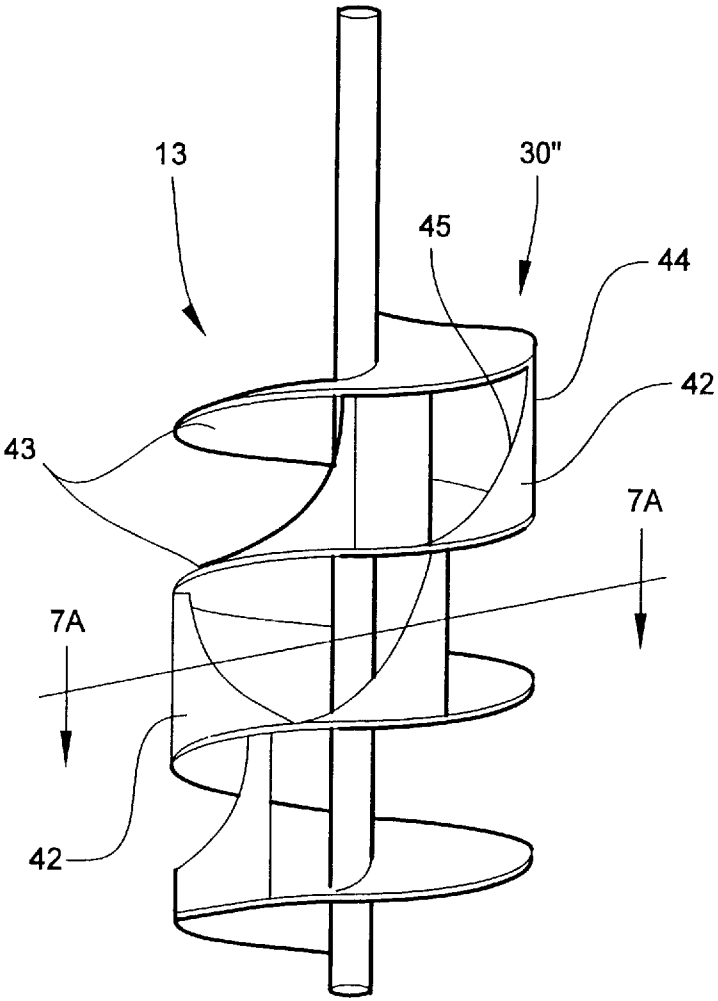
FIG. 7 is a perspective view of a helical auger bit with tapered blades for use on a continuous ditch excavator according to a preferred embodiment of the invention.

FIGS. 5, 5A, 6, 6A, 7, and 7A illustrate three alternative blade assemblies for the auger 13. FIGS. 5 and 5A show an auger blade assembly 30 comprising a plurality of blade plate sets, each blade plate set 31 comprising a plurality of vertically aligned blade plates 32, each pair of adjacent turns 33 in the auger 13 having a blade plate 32 mounted therebetween. FIGS. 6 and 6A show an auger blade assembly 30' comprising a plurality of blades 34, each blade 34 extending from the uppermost turn 35 of the auger 13 to the lowermost turn 40 of the auger 13 and being mounted in a substantially vertical position across the outer edges of the auger turns 41. FIGS. 7 and 7A show an auger blade assembly 30" comprising a plurality of plow-type blades 42, each blade 42 being mounted between adjacent turns 43 in the auger 13. In this preferred embodiment, each blade includes a substantially vertical edge 44 and an edge 45 sloping in the downward direction of the auger turns 43. These three auger blade assemblies are exemplary only; the invention may be used with other blade assemblies depending on the desired ditch dimensions.

Figure 9:
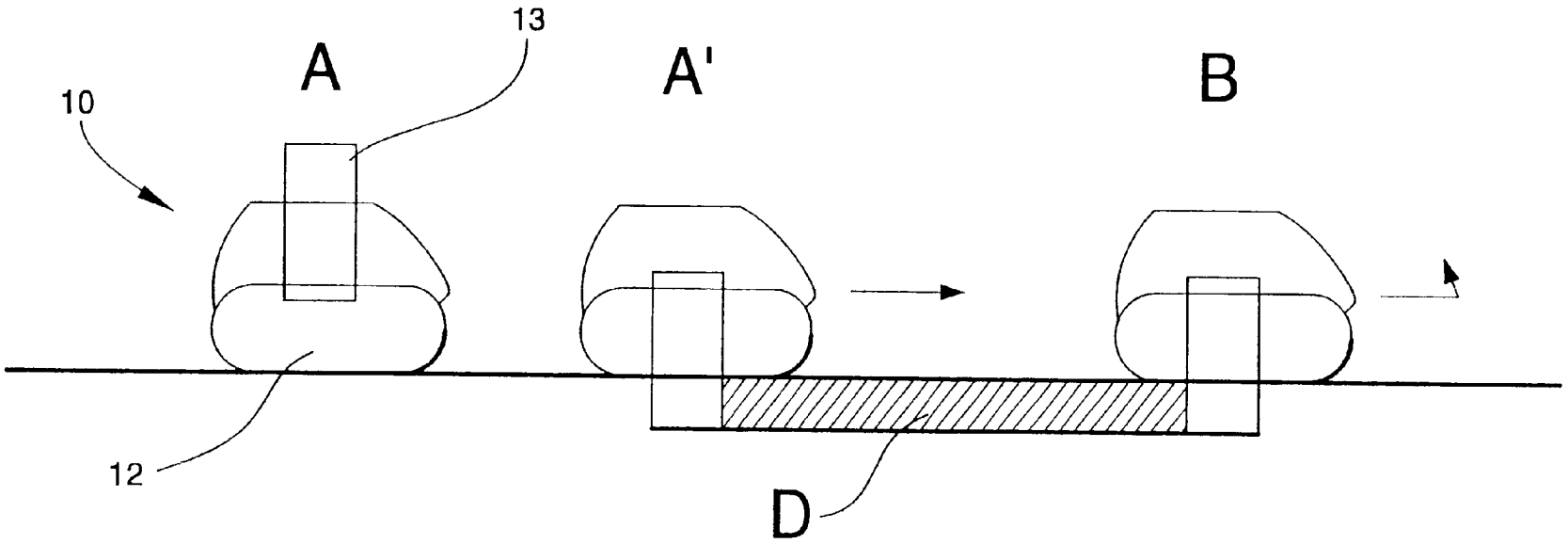
FIG. 9 is a side elevation of a simplified line drawing of a continuous ditch excavator according to a preferred embodiment of the invention showing the excavator at three successive stages of excavation, including, as indicated by arrows, the excavation of a sharp turn in the ditch path.

Turning now to FIG. 8, the advantage provided by the substantially central disposition of the auger 13 is illustrated in a simplified line drawing. As shown particularly at position "B" in FIG. 8, a ditch "D" having a 90-degree turn may be excavated by the excavator 10 without the need for raising the auger 13 out of the ditch "D" and repositioning the excavator 10. In this way, the auger 13 defines a pivot point about which the excavator 10 may be rotated without removing the auger 13 from the ditch "D". This rotating and pivoting action is best achieved when the auger 13 is substantially centrally disposed within the excavation area 50 defined by the caterpillar tracks 12. FIG. 9 shows another view of this action in simplified line drawing form.

Figure 10:
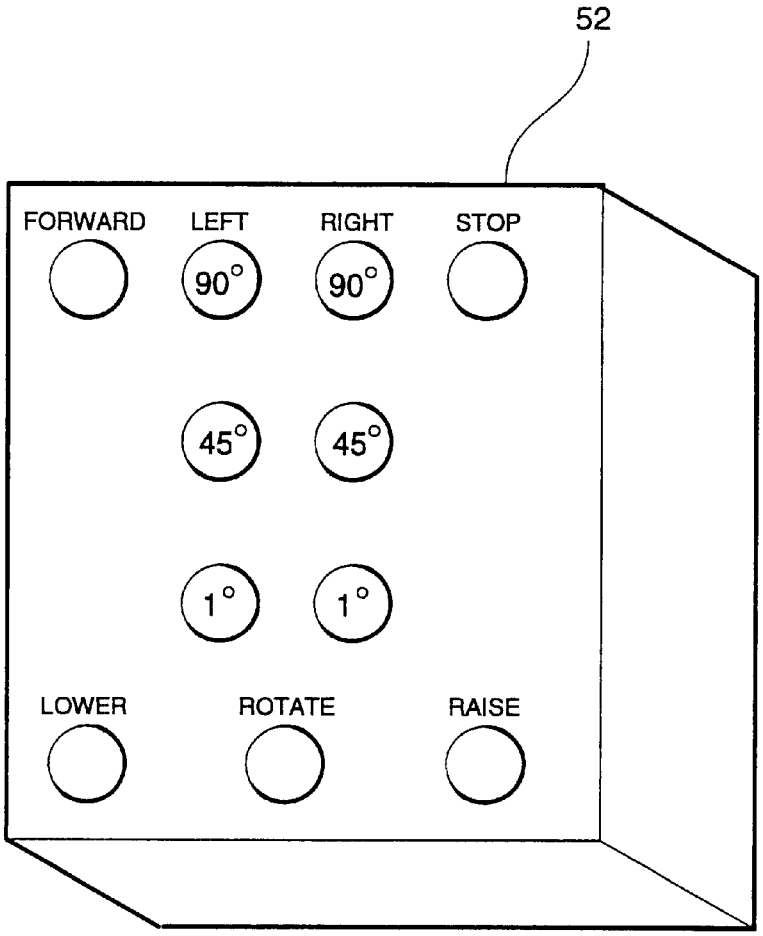
FIG. 10 is a perspective view of a remote control used to remotely operate a continuous ditch excavator according to a preferred embodiment of the invention.
Figure 11:
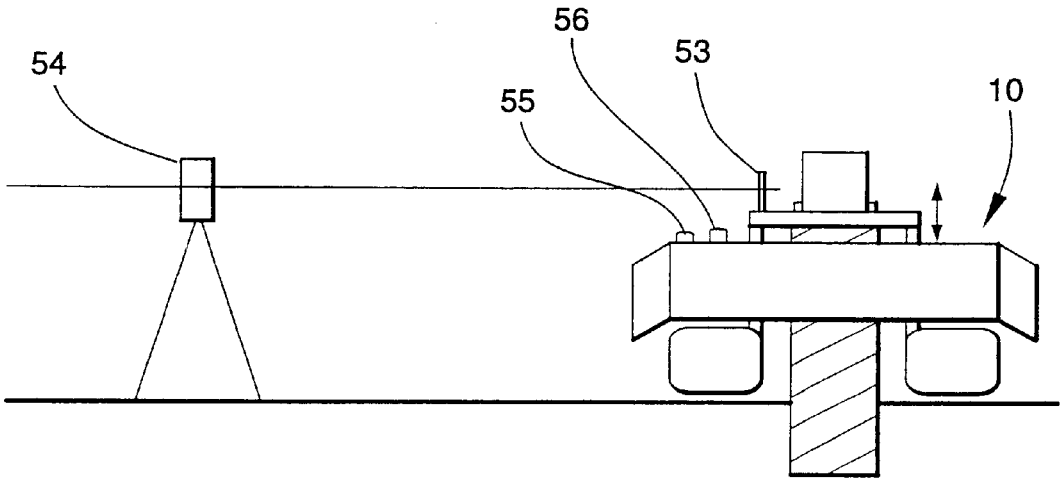
FIG. 11 is a side elevation of a simplified line drawing of a laser guide communicating with and guiding a continuous ditch excavator according to a preferred embodiment of the invention.

FIGS. 1, 10, and 11 illustrate three alternative means of controlling the excavator. Looking first to FIG. 1, an operator cab 51 is shown. The operator cab provides for a human operator "H" to ride aboard the excavator 10. The operator cab includes sufficient speed and direction controls 57 to allow the onboard human operator "H" to manipulate the caterpillar tracks 12, the auger 13, and any other adjustable elements as desired to form a ditch of predetermined dimensions. Alternatively, the excavator 10 may be provided with a sensor and processor (FIG. 11, reference numeral 55) to respond to and execute instructions transmitted by, as shown in FIG. 10, a human-operated remote control unit such as that illustrated at reference numeral 52, thereby allowing remote control of all necessary functions. Thirdly, as shown in simplified line drawing form in FIG. 11, excavator movement may be automated, in part by providing the excavator 10 with an elevation monitor 53 and a distance and direction sensor and processor 56 designed to receive and execute a sequence of computerized instructions (not shown) received from a remote laser level 54, such instructions being programmed in advance to result in the excavation of a ditch of predetermined dimensions.

A continuous ditch excavator is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A continuous ditch excavator comprising:

(a) a chassis having a forward portion and a rear portion;

(b) first and second rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) a rotatably-mounted excavating auger mounted on the chassis in the excavation work area forwardly of the rear portion of the chassis, rearwardly of the forward portion of the chassis and intermediate the first and second driving elements for penetrating and excavating a ditch in the ground as the chassis is driven along the ground, said auger defining a pivot point about which the first and second driving elements are adapted to rotate the chassis to control the direction of ditch excavation; and (d) at least one lift adapted for raising and lowering the auger.

2. A continuous ditch excavator comprising:

(a) a chassis having a forward portion and a rear portion;

(b) first and second rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) a rotatably-mounted excavating auger mounted on the chassis in the excavation work area forwardly of the rear portion of the chassis, rearwardly of the forward portion of the chassis and intermediate the first and second driving elements for penetrating and excavating a ditch in the ground as the chassis is driven along the ground, said auger defining a pivot point about which the first and second driving elements are adapted to rotate the chassis to control the direction of ditch excavation; and (d) a drive motor comprising an engine mounted on the chassis for driving the first and second drive elements and a hydraulic motor mounted on the chassis for rotating, raising, and lowering the auger.

3. A continuous ditch excavator comprising:

(a) a chassis having a forward portion and a rear portion;

(b) first and second rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) a rotatably-mounted excavating auger mounted on the chassis in the excavation work area forwardly of the rear portion of the chassis, rearwardly of the forward portion of the chassis and intermediate the first and second driving elements for penetrating and excavating a ditch in the ground as the chassis is driven along the ground, said auger defining a pivot point about which the first and second driving elements are adapted to rotate the chassis to control the direction of ditch excavation; and (d) a plurality of hydraulic lifts mounted on the chassis for raising and lowering the auger.

4. A continuous ditch excavator according to claim 1, 2, or 3, wherein the auger is mounted in a substantially vertical position.

5. A continuous ditch excavator according to claim 1, 2, or 3, wherein said first and second drive elements comprise caterpillar tracks.

6. A continuous ditch excavator comprising:

(a) a chassis having a forward portion and a rear portion;

(b) first and second rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) a rotatably-mounted excavating auger mounted on the chassis in the excavation work area forwardly of the rear portion of the chassis, rearwardly of the forward portion of the chassis and intermediate the first and second driving elements for penetrating and excavating a ditch in the ground as the chassis is driven along the ground, said auger defining a pivot point about which the first and second driving elements are adapted to rotate the chassis to control the direction of ditch excavation; and (d) a containment bin mounted on the chassis in proximity to the auger for receiving soil removed from the ground by the auger.

7. A continuous ditch excavator according to claim 6, wherein emptying means are provided adjacent to the containment bin for emptying the contents of the containment bin.

8. A continuous ditch excavator according to claim 1, 2, 3, or 6, and further comprising a containment shield adjacent to the auger for preventing the soil removed by the auger from falling back into the ditch as the auger is raised out of the ditch.

9. A continuous ditch excavator according to claim 8, wherein the containment shield includes a first shield component proximal to the forward portion of the chassis and a second shield component proximal to the rear portion of the chassis for partially surrounding the auger as it is raised and lowered into and out of the ditch.

10. A continuous ditch excavator according to claim 9, wherein the first and second shield components are complementary, spaced-apart, arcuate plates partially surrounding the auger.

11. A continuous ditch excavator according to claim 1,2, or 3, further comprising an operator cab mounted on the chassis for accommodating an operator and operator controls.

12. A continuous ditch excavator according to claim 11, wherein the operator controls comprise a plurality of direction and speed controls for manipulating the excavator.

13. A continuous ditch excavator according to claim 11, wherein the operator controls comprise:

(a) a sensor on the excavator for receiving control signals from a remote control unit comprising speed and direction controls; and (b) a processor on the excavator for interpreting the control signals received from the remote control unit by the sensor and for directing the excavator to execute operations included in the control signals.

14. A continuous ditch excavator according to claim 1, 2, or 3, and including operator controls comprising:

(a) a distance and direction sensor mounted on the chassis for sending and receiving information indicative of movement of the first and second drive elements;

(b) a distance and direction processor mounted on the chassis for interpreting the information received by the distance and direction sensor and executing directions contained therein; and (c) an elevation monitor mounted on the chassis for sending and receiving laser signals to and from a laser level positioned in spaced-apart relation to the excavator at a predetermined location, wherein the distance and direction sensor and processor, the elevation monitor, and the laser level of the control means are controlled by a pre-programmed sequence of computerized instructions for directing the excavator along a predetermined path.

15. A continuous ditch excavator, comprising:

(a) a chassis having a forward portion and a rear portion;

(b) a plurality of caterpillar tracks carried by the chassis in laterally spaced-apart relation to each other for cooperatively driving the chassis along a ground surface, said caterpillar tracks defining a centrally-disposed excavation work area therebetween;

(c) an excavating auger mounted in a substantially vertical position on the chassis in the excavation work area, forwardly of the rear portion of the chassis, rearwardly of the forward portion of the chassis and intermediate the first and second driving elements for penetrating and excavating a ditch in the ground as the chassis is driven along the ground, said auger defining a pivot point about which the caterpillar tracks are adapted to pivot the chassis to control the direction of ditch excavation;

(d) an engine mounted on the chassis for driving the caterpillar tracks;

(e) a hydraulic motor mounted on the chassis and driven by the engine for rotating, raising, and lowering the auger;

(f) a plurality of hydraulic lifts mounted on the chassis and powered by the hydraulic motor for raising and lowering the auger; and (g) operator controls for controlling the excavator, comprising a plurality of direction and speed controls accessible from an operating cab carried on the chassis for manipulating the excavator.

16. A method for excavating ditches comprising the steps of:

(a) providing a movable chassis with a vertically-mounted excavating auger mounted thereon, the auger defining a pivot point about which the chassis may be rotated;

(b) penetrating the auger into the ground;

(c) moving the chassis along a predetermined path as the auger is rotated for lifting soil from the earth to form a ditch along the predetermined path; and (d) rotating the chassis about the pivot point defined by the auger for changing the direction of the ditch according to the predetermined path.

17. A method for continuous excavation of ditches according to claim 16, the step of steering the chassis by differential movement of first and second laterally spaced-apart driving elements.

18. A method for continuous excavation of ditches according to claim 16, wherein the step of steering the chassis by differential movement of first and second laterally spaced-apart driving elements comprises the step of rotating first and second endless treads.

19. A method for continuous excavation of ditches according to claim 18, wherein said method further comprises the step of preventing the soil removed by the auger from falling away from the auger into the ditch.

20. A method for continuous excavation of ditches according to claim 19, wherein said method further comprises the step of interrupting the excavation by lifting the auger out of the ditch.

21. A method for continuous excavation of ditches according to claim 16, wherein said method further comprises the step of controlling the excavator with a human operator located a point separated from the excavator.

22. A method for continuous excavation of ditches according to claim 16, wherein said method further comprises the step of controlling the excavator according to a preprogrammed sequence of computerized instructions.

23. A method for continuous excavation of ditches according to claim 16, wherein said method further comprises the step of controlling the operation of the excavator from a position forward on the chassis in relation to the auger.

* * * * *